US005932023A

United States Patent [19]

Ward et al.

[11] Patent Number: 5,932,023

[45] Date of Patent: Aug. 3, 1999

[54] METHOD OF WASHING A VEHICLE USING A TWO-PART WASHING COMPOSITION

[76] Inventors: Glen Douglas Ward, 8181 N. Tammeron Ct., Tucson, Ariz. 85741; Ronald N Peterson, 4801 N. LaLomita, Tucson, Ariz. 85718; Kanjibhai Donda, 10269 N. Mineral Spring La., Tuscon, Ariz. 85737

[21] Appl. No.: 08/805,736

[22] Filed: Feb. 25, 1997

[51] Int. Cl.[6] ..... B08B 3/08; C11D 3/04; C11D 7/08; C11D 7/50

[52] U.S. Cl. ..... 134/3; 134/26; 134/28; 134/41; 134/42; 510/242; 510/241

[58] Field of Search ..... 134/3, 41, 26, 134/28, 42; 510/242, 241, 189, 421, 423, 504

[56] References Cited

U.S. PATENT DOCUMENTS

| | | | |
|---|---|---|---|
| Re. 32,661 | 5/1988 | Binns | 252/142 |
| 3,793,221 | 2/1974 | Otrhalek et al. | 134/3 |
| 3,823,094 | 7/1974 | Lancz | 252/527 |
| 3,922,390 | 11/1975 | Otrhalek et al. | 427/162 |
| 4,116,853 | 9/1978 | Binns | 134/3 |
| 4,367,155 | 1/1983 | Birkelo | 252/99 |
| 4,970,015 | 11/1990 | Garcia | 252/79.4 |
| 5,223,168 | 6/1993 | Holt | 252/142 |
| 5,421,906 | 6/1995 | Borah | 134/26 |
| 5,439,020 | 8/1995 | Lockhart | 137/3 |
| 5,460,694 | 10/1995 | Schapira et al. | 216/104 |
| 5,733,377 | 3/1998 | Howe | 134/3 |

*Primary Examiner*—Zeinab El-Arini
*Attorney, Agent, or Firm*—Renner, Otto, Boisselle & Sklar, P.L.L.

[57] ABSTRACT

The present invention relates to a two-part washing composition containing a first part including water and at least one acid; and a second part separated from the first part, the second part including water and a fluorine containing compound, and at least one of the first part and the second part further containing at least one surfactant. The present invention also relates to a method of washing a vehicle involving providing a two-part washing composition containing a first part containing water and at least one acid and a second part separated from the first part, the second part containing water and a fluorine containing compound, and at least one of the first part and the second part further containing at least one surfactant; combining the first part with the second part to form a second composition; and contacting the vehicle with the second composition.

20 Claims, No Drawings

METHOD OF WASHING A VEHICLE USING A TWO-PART WASHING COMPOSITION

TECHNICAL FIELD

The present invention relates to a two-part washing composition and a method of using the composition. In particular, the present invention relates to a two-part washing composition containing a fluorine containing compound which may be used to wash vehicles.

BACKGROUND OF THE INVENTION

Commercial vehicle cleaning facilities obtain car wash soap from distributors and/or suppliers, usually in concentrated form, and then use the soap concentrate in a car wash system. Typical car wash systems involve diluting the soap concentrate with water, spraying a vehicle with the diluted car wash soap, scrubbing the vehicle, rinsing and drying the vehicle.

Hydrofluoric acid has desirable cleaning properties associated with its use. However, serious hazards exist in connection with the storage, use and exposure to compositions containing hydrofluoric acid. In addition to common hazards generally associated with strong acids, hydrofluoric acid has several hazards particularly related to fluoride ions. For example, upon contact with the human body, fluoride ion in an acidic environment readily penetrates the skin causing destruction of deep tissue layers including bone tissue. This is because fluoride ion is not rapidly neutralized by the human body, unlike many other compounds such as phosphoric acid. Moreover, the effects on the human body due to exposure to hydrofluoric acid are often not readily detected, and in fact, take hours and sometimes days to become apparent.

In light of the circumstances described above, there are potential hazards and dangers associated with the proposition of transporting, storing and using car wash formulations containing hydrofluoric acid. The present invention overcomes these potential hazards and dangers.

SUMMARY OF THE INVENTION

In one embodiment, the present invention relates to a two-part washing composition containing a first part including water and at least one acid; and a second part separated from the first part, the second part including water and a fluorine containing compound, and at least one of the first part and the second part further containing at least one surfactant.

In another embodiment, the present invention also relates to a method of washing a vehicle involving providing a two-part washing composition containing a first part including water and at least one acid and a second part separated from the first part, the second part including water and a fluorine containing compound, and at least one of the first part and the second part further containing at least one surfactant; combining the first part with the second part to form a second composition; and contacting the vehicle with the second composition.

As a result of the present invention, a car wash composition having excellent cleaning properties including desirable properties associated with the presence of hydrofluoric acid, is provided in a safe and handleable manner. This is because the two-part washing composition of the present invention contains two parts which remain separate from each other until just before actual use of the washing composition is required. The hazards and dangers associated with transporting, storing, handling and using hydrofluoric acid are eliminated.

DESCRIPTION OF THE PREFERRED EMBODIMENTS

In the following description, a number of features and parameters are described, defined and/or exemplified with one or more numerical values in a range. It is to be understood that any combination of the values of the ranges described herein may be used. For instance, the higher value of one specific range may be combined with the lower value of another specific range to describe an additional range of values.

The term "hydrocarbyl" includes hydrocarbon as well as substantially hydrocarbon groups. Substantially hydrocarbon describes groups which contain heteroatom substituents which do not alter the predominantly hydrocarbon nature of the group. Examples of hydrocarbyl groups include hydrocarbon substituents, i.e., aliphatic (e.g., alkyl or alkenyl) and substituted aliphatic substituents, alicyclic (e.g., cycloalkyl, cycloalkenyl) substituents, aromatic-, aliphatic- and alicyclic-substituted aromatic substituents. Heteroatoms include, by way of example, nitrogen, oxygen and sulfur.

The present invention relates to a two-part washing composition. The two parts are separate from each other; that is, the two parts of the two-part washing composition are in separate containers or packaging or compartments or otherwise not in contact with each other. In one embodiment, the two parts remain separate until just prior to using the washing composition wherein the two parts are combined, optionally diluted and put immediately to use. In this way, the two parts of the washing composition remain separate during storage and distribution.

The first part of the washing composition contains an aqueous solution of at least one acid. Acids include organic acids such as carboxylic acids containing 1 to about 50 and preferably about 2 to about 12 carbon atoms and inorganic acids such as mineral acids.

Specific examples of inorganic acids include nitric acid, halogen acids such as hydrochloric acid, perchloric acid, hydrobromic acid and hydroiodic acid, sulfuric acid, sulfurous acid, boric acid and phosphorous acids such as phosphorous acid, phosphoric acid and polyphosphoric acids and mixtures or combinations thereof. Of these inorganic acids, phosphoric acid is preferred. In one embodiment, two or more inorganic acids are present in the first part (or at least one inorganic acid and at least one organic acid), and in another embodiment, 3 or more inorganic acids are present in the first part (or at least one inorganic acid and at least one organic acid).

Organic acids include carboxylic acids and polycarboxylic acids such as alkanoic acids, including formic acid, acetic acid, propionic acid, butyric acid and so on (generally containing 1 to about 10 carbon atoms), dicarboxylic acids (generally containing 1 to about 12 carbon atoms), hydroxyalkanoic acids, such as citric acid (generally containing 1 to about 10 carbon atoms), organic phosphorous acids such as dimethylphosphoric acid and dimethylphosphinic acid, sulfonic acids such as hydrocarbylsulfonic acids (containing 1 to about 20 carbon atoms). Moreover, in some embodiments, two or more of any of the above-described acids may be used. Preferred organic acids include acetic acid and citric acid. In embodiments where the first part contains two or more acids, preferred combinations include acetic acid and nitric acid, acetic acid and phosphoric acid, acetic acid and sulfuric acid, nitric acid and phosphoric acid, nitric acid and sulfuric acid, phosphoric acid and sulfuric acid, and acetic acid, phosphoric acid and sulfuric acid.

In one embodiment, the amount of acid (total amount in embodiments where the first part contains two or more acids) in the first part of the washing composition is from about 0.1% to about 70%, and preferably from about 0.2% to about 60%. In another embodiment, when the washing composition is in concentrated form, the amount of acid in the first part is from about 30% to about 70%, and preferably from about 40% to about 60%. In another embodiment, when the washing composition is not in concentrated form, the amount of acid in the first part is from about 0.1% to about 5%, and preferably from about 0.2% to about 2%. In one embodiment, the first part of the washing composition containing at least one acid may optionally contain one or more additives as described later.

The second part of the washing composition contains an aqueous solution containing a fluorine containing compound. The fluorine containing compound is a compound containing a fluorine atom, but is not hydrofluoric acid. In one embodiment, the fluorine containing compound is any compound which is capable of producing fluoride ion in an aqueous solution. In another embodiment, the fluorine containing compound is a fluorine containing salt. In preferable embodiments, the fluorine containing compound is soluble in an aqueous solution.

Fluorine containing compounds generally include metal fluorides such as alkali metal, alkaline earth metal, transition metal and other metal fluorides as well as organic fluorides such as ammonium and alkyl ammonium fluorides. Specific examples of the fluorine containing compound include one or more of ammonium fluoride, tin (II) fluoride, tin (IV) fluoride, lead fluoride, alkali and alkaline earth metal fluorides such as sodium fluoride, potassium fluoride, magnesium fluoride, lithium fluoride, calcium fluoride, rubidium fluoride, strontium fluoride, cesium fluoride, and barium fluoride. Sodium, potassium, ammonium and tin fluorides are preferred.

In one embodiment, the amount of the fluorine containing compound in the second part of the washing composition is from about 0.01% to about 60%, and preferably from about 0.1% to about 35%. In another embodiment, where part two of the washing composition is in concentrated form, the amount of fluorine containing compound is from about 8% to about 60%, and preferably from about 25% to about 35%. In another embodiment, where part two of the washing composition is not in concentrated form, the amount of fluorine containing compound is from about 0.01% to about 2%, and preferably from about 0.1% to about 1%.

At least one of the first part and the second part of the washing composition also contains at least one surfactant. Surfactants include anionic, cationic, nonionic and amphoteric surfactants. These surfactants are known in the art, and many of these surfactants are described in McCutcheon's "Volume I: Emulsifiers and Detergents", 1995, North American Edition, published by McCutcheon's Division MCP Publishing Corp., Glen Rock, N.J., and in particular, pp. 1–232 which describes a number of anionic, cationic, nonionic and amphoteric surfactants and is hereby incorporated by reference for the disclosure in this regard. In a preferred embodiment, the surfactant is a nonionic surfactant. In another preferred embodiment, the surfactant contains two surfactants and one surfactant is a nonionic surfactant and the other is a cationic surfactant. In another embodiment, the surfactant contains two surfactants and one surfactant is an amphoteric surfactant and the other is a cationic surfactant.

In one embodiment, the first part or the acid part contains at least one surfactant. In another embodiment, the second part or the fluorine part contains at least one surfactant. In yet another embodiment, both the first part and the second part contain at least one surfactant. In this embodiment, the first part and the second part may contain the same or different surfactants.

In one embodiment, the amount of the surfactant in either or both the first part and the second part of the washing composition is from about 0.01% to about 60%, and preferably from about 0.1% to about 40%. In another embodiment, where either or both parts of the washing composition are in concentrated form, the amount of surfactant is from about 5% to about 40%. In another embodiment, where either or both parts of the washing composition are not in concentrated form, the amount of surfactant is from about 0.01% to about 5%.

In one embodiment, the surfactant is a polysaccharide or a sucrose and/or glucose ester or derivatives thereof such as lauryl polyglucose, alkyl polyglycosides, and alkyl polysaccharide ethers wherein the alkyl group contains from about 8 to about 16 carbon atoms. In a preferred embodiment, the surfactant is a nonionic polysaccharide or sucrose and/or glucose ester or derivatives thereof. These surfactants are commercially available from Henkel under the general trade designation "Glucopon®" and specifically under the designations AV-110, AV-120, LD-15, 225, 225 DK, 425, 425CS, 600, and 600CS, and under the general trade designation "Plantaren®" and specifically those under the designations PS, 1200, and 2000; and from Burlington Chemical under the general trade designation "Burco" and specifically under the general designations NPS-50, NPS-225, and NPS-816; and from Amerchol under the general trade designations "Glucamate®" and "Glucate®" and specifically under the designations DOE-120, SSE-20, DO, and SS; and from DeForest Enterprises under the trade designation "DeSulf" and specifically under the designations GOS-P-70 and GOS-P-70WCG; and from PPG Industries under the general trade designation "Mazon" and specifically under the designations 40, 40A, and 85; and from Union Carbide under the general trade designation "Triton®" and specifically those under the designations BG-10 and CG-110.

In another embodiment, the surfactant is an ethoxylated alcohol surfactant or a derivative thereof. Ethoxylated alcohol surfactants include ethoxylated linear alcohols, polyoxyethylene alkyl ethers, polyoxyethylated fatty alcohols, alkyl poly ethers, polyoxyethylene alkyl phenols, and ethoxylated alkyl phenols. Ethoxylated alcohol surfactants are commercially available from Vista Chemical under the general trade designation "Alfonic®", from ICI Surfactants under the trade designations "Atlas" and "Brij", from Witco under the general trade designation "DeSonic®", from Henkel under the general trade designations "Eumulgin", "Generol®" and "Trycol", and from Hoechst Celanese under the general trade designation "Genapol®", from Lipo Chemicals under the general trade designation "Lipowax", and from Shell Chemical under the general trade designation "Neodol®", from Rhone-Poulenc under the general trade designation "Rhodasurf", and from Huntsman Corporation under the general trade designation "Surfonic®", and from Union Carbide under the general trade designation "Triton®".

In another embodiment, the surfactant is a diphenyl sulfonate surfactant or a derivative thereof. In a preferred embodiment, the surfactant is an anionic diphenyl sulfonate derivative surfactant. Diphenyl sulfonate surfactants include sodium hexyl diphenyloxide disulfonate, sodium decyl diphenyloxide disulfonate, sodium dodecyl diphenyloxide disulfonate, sodium n-hexadecyl diphenyloxide disulfonate, and dodecyl diphenyloxide disulfonic acid. Diphenyl sulfonate surfactants are commercially available from Dow Chemical under the general trade designation "Dowfax" and specifically those under the designations C6L, C10 L, 2AO, 2A1, 2A1-D, 2EP, 3BO, 3B2, 3B2-D, 2000, 8390, and 8390-D; from Pilot Chemical under the general trade designation "Calfax", from Olin Corporation under the trade designation "Poly-Tergent"; and from Rhone-Poulenc under the trade designation "Rhodacal DSB".

In another embodiment, the surfactant is an amphoteric surfactant such as a phosphated amphoteric surfactant or a derivative thereof. Phosphated amphoteric surfactants are commercially available from Mona Industries under the trade designation "Phosphoteric T-C6" and "Phosphoteric QL-38". Other amphoteric sufactants are commercially available from Tomah Products under the trade designation "Amphoteric SC", "Amphoteric N", "Amphoteric TC", and "Amphoteric 400".

In another embodiment, the surfactant is a modified alkoxylated surfactant. Modified alkoxylated surfactants include alkoxylated alcohols, and alkoxylated phenols. In one embodiment, the alkoxylated alcohol includes ethoxylated and propoxylated alcohols having from 1 to about 30 carbon atoms, or from about 4 to about 24 carbon atoms, or from about 6 to about 18 carbon atoms. These materials may be prepared by reacting an alcohol with an alkylene oxide such as ethylene oxide or propylene oxide. Modified ethoxylates surfactants are generally ethoxylated alcohols commercially available from Union Carbide under the general trade designation "Triton®", and specifically those under the designation DF-12, DF-16, DF-18, and DF-20.

In another embodiment, the surfactant is a fluorocarbon based surfactant. A fluorocarbon based surfactant may be an anionic, cationic, nonionic or amphoteric surfactant. Fluorocarbon surfactants are commercially available from DuPont under the general trade designation "Zonyl" and from 3M Company under the general trade designation "Fluorad".

The washing composition described herein is generally an aqueous composition. The water is preferably deionized water, although tap water may be used. However, organic liquids, such as alcohols, may be present in the washing composition so long as the effectiveness of the composition is not substantially decreased. While various amounts of certain components of the washing composition are described herein, the amounts of the various components generally do not add up exactly to 100%. In this connection, it is to be understood that the balance of the washing composition is water and any other components which do not affect the performance of the washing composition (unavoidable impurities and/or additional solvents or trace compounds).

In one embodiment, the washing composition, either the first part or the second part, optionally contains a coupling agent. In some embodiments, the coupling agent can promote solvation of the surfactant in the washing composition. When a coupling agent is present it is preferable that the coupling agent is present in the part or parts of the washing composition containing a surfactant. In a preferred embodiment, the coupling agent is a glycol ether.

In one embodiment, glycol ethers include alkylene glycol mono- and dialkyl ethers (where the alkyl and alkylene groups contain from 1 to about 12 and preferably 1 to about 8 carbon atoms). Glycol ethers specifically include ethylene, polyethylene such as diethylene, propylene, and polypropylene such as dipropylene glycol mono- and dialkylethers. Glycol ethers may be represented by

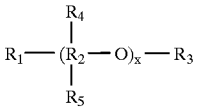

where $R_1$, $R_2$, $R_4$ and $R_5$ are each independently hydrogen or hydrocarbyl groups containing 1 to about 8 and preferably 1 to about 5 carbon atoms, $R_3$ is an alkylene group containing 1 to about 8 and preferably 1 to about 5 carbon atoms, and x is 1 to about 20 and preferably 1 to about 3. In particular, glycol ethers include ethylene glycol ethers, propylene glycol ethers, butylene glycol ethers, di(ethylene glycol) ethers, di(propylene glycol) ethers, di(butylene glycol) ethers, tri(ethylene glycol) ethers, tri(propylene glycol) ethers, tri(butylene glycol) ethers and other poly (ethylene, propylene or butylene) glycol ethers. Glycol ethers also include ethylene, polyethylene, propylene and polypropylene mono- and diphenylethers such as ethylene glycol mono phenyl ether.

Specific examples of glycol ethers include ethylene glycol methyl ether, ethylene glycol methylbutyl ether, ethylene glycol ethylbutyl ether, ethylene glycol ethyl ether, ethylene glycol butyl ether, ethylene glycol dimethyl ether, ethylene glycol diethyl ether, ethylene glycol dibutyl ether, propylene glycol methyl ether, propylene glycol ethyl ether, propylene glycol butyl ether, propylene glycol dimethyl ether, propylene glycol diethyl ether, propylene glycol dibutyl ether, di(ethylene glycol) methyl ether, di(ethylene glycol) ethyl ether, di(ethylene glycol) butyl ether, di(ethylene glycol) hexyl ether, di(ethylene glycol) dimethyl ether, di(ethylene glycol) diethyl ether, di(ethylene glycol) dibutyl ether, di(ethylene glycol) butylmethyl ether, di(ethylene glycol) dodecyl ether, di(propylene glycol) methyl ether, di(propylene glycol) butyl ether, tri(ethylene glycol) methyl ether, tri(ethylene glycol) dimethyl ether, tri(propylene glycol) methyl ether, tri(propylene glycol) butyl ether, and mixtures thereof. Glycol ethers are available from Union Carbide under the name Cellosolve®, Dow Chemical under the name Dowanol® and Arco Chemical under the name Arcosolv. Preferred glycol ethers include ethylene glycol butyl ether, and di(ethylene glycol) butyl ether. In one embodiment, the amount of the coupling agent in either or both the first part and the second part of the washing composition is from about 0.01% to about 20%, and preferably from about 0.1% to about 10%. In another embodiment, where either or both parts of the washing composition are in concentrated form, the amount of the coupling agent is from about 2% to about 20%. In another embodiment, where either or both parts of the washing composition are not in concentrated form, the amount of coupling agent is from about 0.01% to about 1%.

In one embodiment, the washing composition optionally contains one or more additives. In one embodiment, either one or both of the first part or the second part contain one or more of the optional additives. In a preferable embodiment, the additives are included in the second part of the washing composition. Examples of various additives include organic solvents, cleaning agents, pH adjusting agents, odorants, detergents, wetting agents, particulate matter and foaming agents.

In operation, the two-part washing composition may be used as follows. The first part and the second part of the washing composition, which are separated, for instance, by being packaged in different containers, are combined to form a combined washing solution. The first part and the second part may be combined by mixing, blending or other methods known to those skilled in the art. In a preferred embodiment, the two-part washing composition is diluted with water before it is used. In one embodiment, where either or both of the first part and the second part are in concentrated form, diluting with water must occur. In another embodiment, the first part and the second part are individually diluted with water prior to mixing or blending. In another embodiment, the first part and the second part are combined and subsequently diluted with water to form a combined washing solution.

The amount of water used to dilute the washing composition can vary depending upon a number of factors. For example, factors may include the precise amounts of the individual components in the first and second parts of the washing compositions, the specific identity of the individual components in the first and second parts of the washing compositions, the intended use of the washing composition. Specific examples include situations where the washing composition is diluted by a ratio (by weight or volume) of 1:2, 1:5, 1:10, 1:50, 1:100, 1:200 or 1:500.

Irrespective of whether or not the washing composition is diluted with water, the combined washing composition (made by combining the first and second parts and optionally diluting with water), contains from about 0.1% to about 70% of acid (total acid content if the composition contains two or more acids), from about 0.1% to about 60% of a fluorine containing compound, from about 0.01% to about 60% of at least one surfactant, and optionally from about 0.01% to about 20% of a coupling agent. In a preferred embodiment, the washing composition is diluted with water, after which the combined washing composition contains from about 0.05% to about 1% of acid, from about 0.05% to about 1% of a fluorine containing compound, and from about 0.001% to about 1% of at least one surfactant, and optionally from about 0.005% to about 1% of a coupling agent.

In a preferred embodiment, the combined washing solution is immediately contacted with a vehicle. In other words, since the washing composition may be stored in its two part state, it is only necessary to combine amounts of the first and second parts as needed by any particular use. The combined washing solution is contacted with a vehicle by any means known to those skilled in the art. For example, the combined washing solution may be contacted with a vehicle by spraying, scrubbing, immersing, and/or applied via cleaning utensils such as cloths, brushes and the like.

The vehicles which may be contacted with the washing composition include cars, trucks such as pick-up trucks or tractor-trailers, vans, sport utility vehicles, motorized bicycles, trailers, rail cars, aircrafts, watercrafts, and recreational vehicles. There are no particular limits as to the type of vehicle which may contacted with the washing composition.

In a preferred embodiment, after the vehicle has been contacted with the washing composition, the vehicle is rinsed with water. The water not only neutralizes the surface but also removes debris and excess washing composition remaining on the vehicle. Rinsing may also prevent film formation and spotting of the vehicle after drying.

At various times during the process, the amounts of the individual components of the washing composition can be monitored and then adjusted accordingly. Preferably, after the first part and the second part have been combined and optionally diluted with water, and before a vehicle is contacted with the combined washing solution, the combined solution may be periodically monitored or tested to insure that the amounts of the individual components are appropriate. For example, an acid titration procedure can be used to monitor the amount of acid in the combined (or the first part) washing solution.

The following specific examples illustrate the present invention. Unless otherwise indicated in the examples and elsewhere in the specification and claims, all parts and percentages are by weight, temperatures are in degrees centigrade, and pressures are at or near atmospheric pressure.

The first three examples illustrate the first part or the acid part of the two-part washing composition. The fourth to the eleventh examples illustrate the second part or the fluorine containing compound part of the two-part washing composition. Any of the exemplified acid parts may be combined with any of the fluorine containing compound parts to form the inventive two-part washing composition. For example, the two-part washing composition may be comprised by a combination of examples 1 and 4, 1 and 5, 1 and 6, 1 and 7, 1 and 8, 1 and 9, 1 and 10, 2 and 4, 2 and 5, 2 and 6, 2 and 7, 2 and 8, 2 and 9, 2 and 10, 3 and 4, 3 and 5, 3 and 6, 3 and 7, 3 and 8, 3 and 9, 3 and 10, and 3 and 11. These examples can preferably be diluted with water before use.

EXAMPLE 1

A composition containing 5% deionized water, 72% of a 75% phosphoric acid aqueous solution and 23% of a 50% citric acid aqueous solution is provided.

EXAMPLE 2

A composition containing 50% deionized water, 20% of concentrated phosphoric acid, 20% of concentrated sulfuric acid, and 10% of concentrated hydrochloric acid is provided.

EXAMPLE 3

A composition containing 50% deionized water, 20% of concentrated phosphoric acid, 30% of concentrated sulfuric acid, and 15% of Glucopon 425 from Henkel is provided.

EXAMPLE 4

A composition containing 30% deionized water, 29% of a 36% ammonium fluoride aqueous solution, 40% of Phosphoteric T-C6 from Mona Industries, and 1% of Zonyl FSD from DuPont is provided.

EXAMPLE 5

A composition containing 30% deionized water, 29% of a 36% ammonium fluoride aqueous solution, 40% of Amphoteric SC from Tomah Products, and 1% of Zonyl FSD from DuPont is provided.

EXAMPLE 6

A composition containing 30% deionized water, 28% of a 36% ammonium fluoride aqueous solution, 40% of Phosphoteric T-C6 from Mona Industries, and 2% of Dowfax C6L from Dow Chemical is provided.

EXAMPLE 7

A composition containing 15% deionized water, 30% of a 36% ammonium fluoride aqueous solution, 40% of Amphoteric SC from Tomah Products, and 15% of AO-8 from Huntington is provided.

EXAMPLE 8

A composition containing 20% deionized water, 30% of a 36% ammonium fluoride aqueous solution, 40% of Glucopon 425 from Henkel, and 10% of AO-8 from Huntington is provided.

EXAMPLE 9

A composition containing 15% deionized water, 40% of a 25% potassium fluoride aqueous solution, 30% of Glucopon 425 from Henkel, 10% of Dowfax 8390 from Dow Chemical and 5% of ethylene glycol monobutyl ether is provided.

EXAMPLE 10

A composition containing 85% of a 36% ammonium fluoride aqueous solution and 15% of Glucopon 425 from Henkel is provided.

EXAMPLE 11

A composition containing 85% of a 36% ammonium fluoride aqueous solution is provided.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as falling within the scope of the appended claims.

What is claimed is:

1. A method of washing a vehicle comprising:

providing a two-part washing composition comprising a first part comprising water and at least one acid and a second part separated from the first part, the second part comprising water and a fluorine containing compound, and at least one of the first part and the second part further comprising at least one surfactant;

combining the first part with the second part to form a second composition; and contacting the vehicle with the second composition, wherein the first part and the second part are combined to form the second composition immediately prior to contacting the vehicle with the second composition.

2. The method of claim 1, further comprising diluting the second composition with water before contacting the vehicle with the second composition.

3. The method of claim 1, wherein the vehicle is a car.

4. The method of claim 1, wherein the second composition comprises from about 0.05% to about 1% by weight acid, from about 0.05% to about 1% by weight fluorine containing compound, from about 0.001% to about 1% by weight of at least one surfactant, and water.

5. The method of claim 1, wherein the acid comprises at least one selected form the group consisting of acetic acid, hydrochloric acid, phosphoric acid, and sulfuric acid.

6. The method of claim 1, wherein the fluorine containing compound comprises a fluoride salt.

7. The method of claim 1, wherein the fluorine containing compound comprises at least one selected from the group consisting of ammonium fluoride, calcium fluoride, magnesium fluoride, tin fluoride, and sodium fluoride.

8. The method of claim 1, wherein the surfactant comprises a nonionic surfactant and a cationic surfactant.

9. The method of claim 1, wherein contacting the vehicle with the second composition is accomplished by spraying.

10. The method of claim 1, further comprising rinsing the vehicle with water.

11. A method of washing a car or truck comprising:

providing a two-part washing composition comprising a first part comprising water and at least one acid and a second part separated from the first part, the second part comprising water and a fluorine containing compound, and at least one of the first part and the second part further comprising at least one surfactant and at least one coupling agent;

combining the first part with the second part to form a second composition; and contacting the car or truck with the second composition, wherein the first part and the second part are combined to form the second composition immediately prior to contacting the car or truck with the second composition.

12. The method of claim 11, further comprising diluting the second composition with water before contacting the car or truck with the second composition.

13. The method of claim 11, wherein the second composition comprises from about 0.05% to about 1% by weight acid, from about 0.05% to about 1% by weight fluorine containing compound, from about 0.001% to about 1% by weight of at least one surfactant, from about 0.01% to about 1% by weight of at least one coupling agent, and water.

14. The method of claim 11, wherein the acid comprises at least one selected from the group consisting of acetic acid, hydrochloric acid, phosphoric acid, and sulfuric acid.

15. The method of claim 11, wherein the fluorine containing compound comprises a fluoride salt.

16. The method of claim 11, wherein the fluorine containing compound comprises at least one selected from the group consisting of ammonium fluoride, calcium fluoride, magnesium fluoride, tin fluoride, and sodium fluoride.

17. The method of claim 11, wherein the surfactant comprises a nonionic surfactant and a cationic surfactant.

18. The method of claim 11, wherein contacting the car or truck with the second composition is accomplished by spraying.

19. The method of claim 11, further comprising rising the car or truck with water.

20. A method of washing a car or truck comprising:

providing a concentrated two-part washing composition comprising a first part comprising water and from about 30% to about 70% by weight of at least one acid and a second part separated from the first part, the second part comprising water and from about 8% to about 60% by weight of a fluorine containing compound, and at least one of the first part and the second part further comprising from about 5% to about 40% by weight of at least one surfactant and from about 2% to about 20% by weight of at least one coupling agent;

combining the first part with the second part to form a second composition; and contacting the car or truck with the second composition, wherein the first part and the second part are combined to form the second composition immediately prior to contacting the car or truck with the second composition.

* * * * *